US006209138B1

(12) United States Patent
Kang

(10) Patent No.: US 6,209,138 B1
(45) Date of Patent: Apr. 3, 2001

(54) ANTI-SLIP ATHLETIC GLOVE HAVING IMPROVED FIT

(75) Inventor: Hye-sook Kang, Seoul (KR)

(73) Assignee: Hanyoung Kangaroo Co., Ltd., Seoul (KR)

( * ) Notice: Subject to any disclaimer, the term of this patent is extended or adjusted under 35 U.S.C. 154(b) by 0 days.

(21) Appl. No.: 09/358,651

(22) Filed: Jul. 23, 1999

(51) Int. Cl.[7] ..... A41D 19/00
(52) U.S. Cl. ..... 2/167; 2/167; 2/161.3
(58) Field of Search ..... 2/159, 161.1, 161.2, 2/161.3, 161.8, 163, 167, 168, 169, 161.7, 161.6

(56) References Cited

U.S. PATENT DOCUMENTS 3,597,765 * 8/1971 Stanton ..... 2/159
4,359,783 * 11/1982 Andrews ..... 2/161.1
4,864,660 * 9/1989 Sawyer ..... 2/161.1
5,117,509 * 6/1992 Bowers ..... 2/161.1
5,511,248 * 4/1996 Widdemer ..... 2/161.3
5,682,613 * 11/1997 Dinatale ..... 2/168
6,044,493 * 4/2000 Post ..... 2/167
6,044,494 * 4/2000 Kang ..... 2/167

* cited by examiner

*Primary Examiner*—Gloria M. Hale
*Assistant Examiner*—Tejash Patel
(74) *Attorney, Agent, or Firm*—Birch, Stewart, Kolasch & Birch, LLP

(57) ABSTRACT

An athletic glove includes a back portion and a palm portion combined therewith to fit the human hand snugly. The respective portions are joined along edges in a substantially continuous manner. The palm portion provides an anti-slip function wherein the back portion includes a composite elastic material, which is a blend of synthetic fiber and spandex. The entire palm portion of the glove includes a single layer of leather having an exterior contact area for gripping.

10 Claims, 3 Drawing Sheets

ANTI-SLIP ATHLETIC GLOVE HAVING IMPROVED FIT

BACKGROUND OF THE INVENTION

1. Field of the Invention

The present invention relates to an athletic glove and, more particularly, to an anti-slip glove having a palm portion for gripping and a back portion made of an elastic material for an improved overall fit, especially for use in conjunction with various athletic activities which require both good fit and an anti-slip function.

2. Description of Related Art

Athletic gloves are widely used for various kinds of sports, including golf, baseball (batting), American football, tennis and racquetball, to cover and thereby protect the human hand from injury, cold weather, etc. Athletic gloves used in these various sports are typically made of a very thin, supple material, such as natural leather or polyurethane artificial leather. Though often worn for protection only, these gloves if properly designed are believed to be essential to enhance athletic performance, with one of the most essential characteristics of an athletic glove being gripping ability.

Basically, athletic gloves offer hand protection along with an enhancement of athletic performance through increased gripping ability. Increased gripping is the intended main effect of any athletic glove. However, increased gripping ability at the cost (trade off) of reduced sensitivity and/or flexibility due to a poor fit is undesirable. Therefore, a better fit, one which retains high flexibility and sensitivity while providing increased gripping ability, is necessary for an improved athletic glove.

A contemporary athletic glove provided with an anti-slip function is wholly made out of a natural or artificial leather. Such material imparts an improved gripping ability, i.e., a high friction coefficient, to the palm side of the glove.

During an act of gripping a golf club, baseball bat or the like using such an athletic glove, the palm side of the glove, being largely comprised of the palm portion but possibly including a thumb portion or related gussets, is gathered in the palm when gripping. In doing so, the back side of the glove, being largely comprised of the back portion but possibly including fourchettes or related gussets, is stretched conversely with respect to the gathering on the palm side and is thereby forced to cover a greater distance along the outer circumference of the backs of the knuckles. That is, in an anti-slip glove exercising its gripping ability, the outer circumferential distance, extending over and lengthwise along the knuckles of the back of the hand, is increased such that the glove back material is drawn taut over the entire back side of the hand and the glove becomes uncomfortable due to a poor fit. Moreover, the tautness of the material of the back side, resulting from the total lack of elasticity in the material, interferes with the gripping action of the glove on the palm side and destroys sensitivity, by exerting unnatural pressure on the hand and distorting the natural gripping action.

To improve the fit, there have been attempts to make the leather material very thin, for example, less than 0.4 mm, in order to restore some degree of flexibility to the glove. Thinner leathers also serve to reduce weight and thereby improve sensitivity. In doing so, however, the glove becomes too weak and lacks the necessary durability. Moreover, leather is not a breathable material; and while holes may be provided to relieve this problem somewhat, the achieved effect is poor and the other problems remain.

Therefore, spandex (i.e., an elastic fiber made of, for example, a synthetic polymer of polyurethane) has been suggested as a solution to the above-described problems of fit in athletic gloves. Spandex, however, provides no anti-slip characteristics. In fact, gloves made of such material provide even less gripping ability than the bare hand.

In essence, mutually exclusive characteristics exist between the spandex material, which cannot provide adequate gripping ability, and the leather material, which cannot provide adequate flexibility. Therefore, there is a substantial need for an athletic glove having an improved fit together with anti-slip characteristics.

SUMMARY OF THE INVENTION

Accordingly, in order to overcome the above drawbacks of conventional athletic gloves, it is the object of the present invention to provide an anti-slip glove exhibiting improved fit characteristics, including snugness and good comfort, over long periods of repeated usage.

It is another object of the present invention to provide an anti-slip glove exhibiting high flexibility characteristics to allow freedom of movement of the wearer's hand and a good fit.

It is yet another object of the present invention to provide an anti-slip glove which is lightweight and durable.

It is still another object of the present invention to provide an anti-slip glove exhibiting high breathability characteristics, to allow for moisture absorption and a cool, dry feel even with prolonged wear.

It is yet still another object of the present invention to provide an anti-slip glove in which an enhanced, suede-like appearance and feel can be attained.

It is a further object of the present invention to provide an anti-slip glove which promotes good gripping ability with a high degree of sensitivity.

Therefore, in accordance with a preferred embodiment of the present invention, there is provided an athletic glove comprising a back portion and a palm portion combined with the back portion, to fit the human hand snugly by being joined along edges of each portion in a substantially continuous manner, the palm portion providing an anti-slip function, wherein the back portion consists essentially of a composite elastic material.

The palm portion and back portion are made of different materials, the palm portion being made essentially of natural or artificial leather.

The composite elastic material is comprised of a blend of a synthetic fiber and spandex, wherein the synthetic fiber comprises 85% to 95% by weight of the composite elastic material, and preferably 91% to 92%, and wherein the spandex comprises 5% to 15% by weight of the composite elastic material, and preferably 8% to 9%.

For the purposes of the technical description herein, the properties of an anti-slip glove described in terms of natural leather can be assumed to coincide with the properties of an anti-slip glove described in terms of artificial leather. Therefore, the term leather material used herein should be taken to mean either a "natural leather for use in an athletic glove" or an "artificial leather for use in an athletic glove in lieu of natural leather."

BRIEF DESCRIPTION OF THE DRAWINGS

The present invention will become more fully understood from the detailed description given hereinbelow and the accompanying drawings, which are given by way of illustration only and thus are not limitative of the present invention, wherein.

DETAILED DESCRIPTION OF THE PREFERRED EMBODIMENTS

Figure 1:
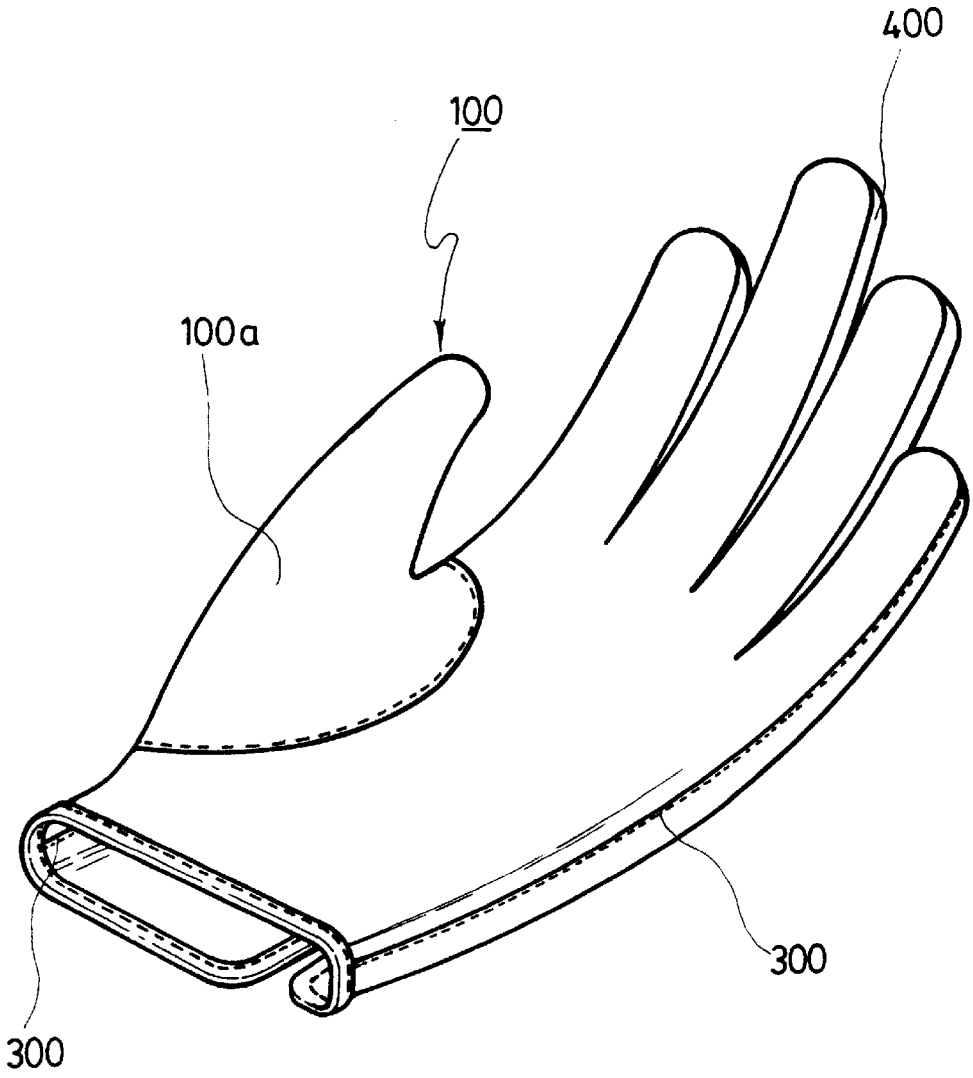
FIG. 1 is a perspective view of an athletic glove according to the present invention, particularly illustrating a palm portion thereof.
Figure 2:
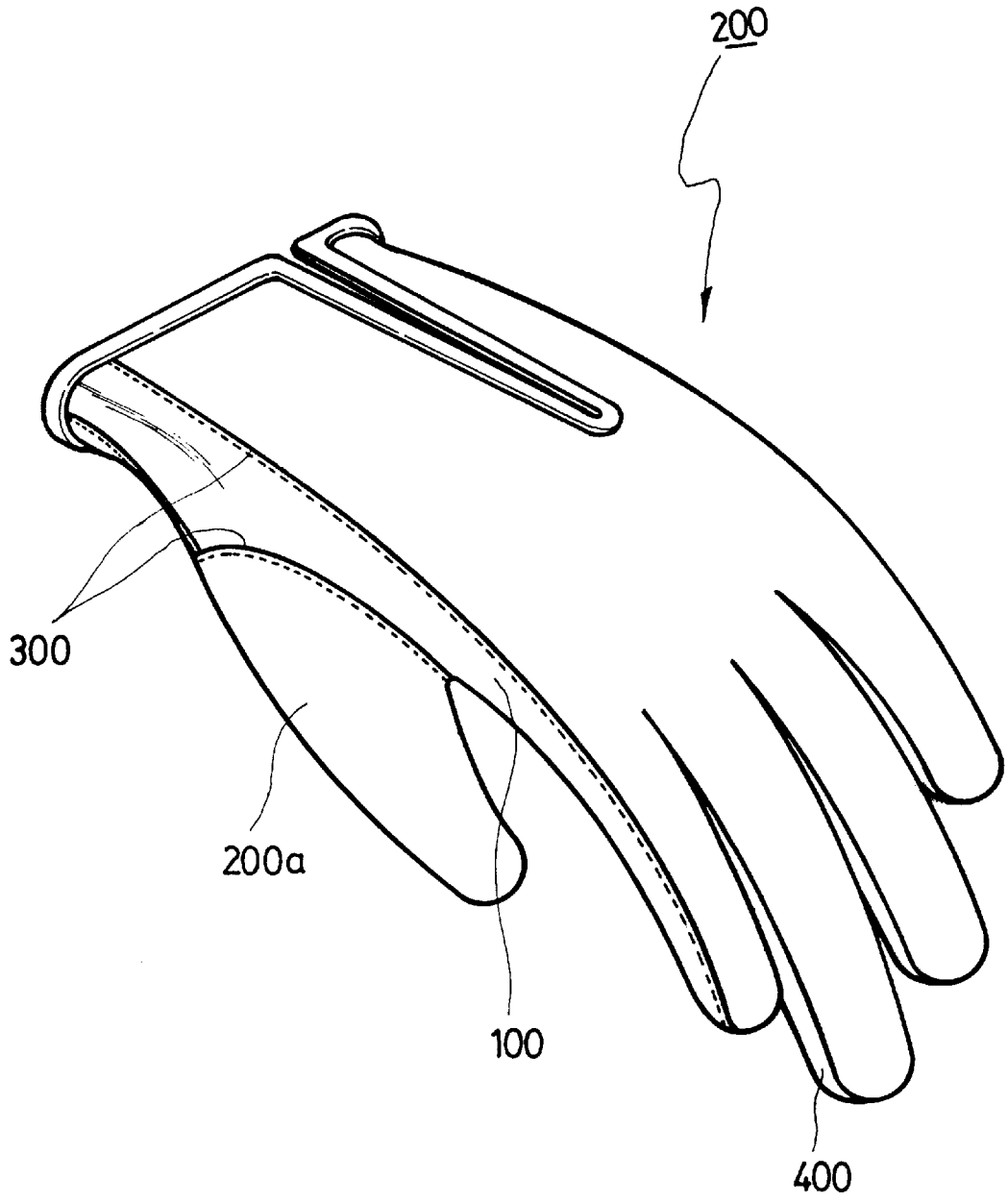
FIG. 2 is a perspective view of an athletic glove according to the present invention, particularly illustrating a back portion thereof.

FIGS. 1 and 2 each show perspective views of an anti-slip athletic glove according to the present invention, wherein FIG. 1 depicts the glove's palm side and FIG. 2 depicts the glove's back side.

Referring to FIGS. 1 and 2, the anti-slip athletic glove according to the present invention is largely comprised of a back portion 200 and a palm portion 100 combined with the back portion to fit the human hand snugly. The two portions are joined along edges 300 of each portion in a substantially continuous manner, e.g., using ordinary joining means such as a sewn seam. The palm portion 100, which may be comprised of a conventional palm portion and provides the anti-slip function, can be made of leather or a similar material, for example, a suede-like man-made fabric. The palm portion 100 typically includes a palm thumb portion 100*a,* so that the back portion 200 includes a separate thumb portion 200*a.* The palm portion 100 and the back portion 200 are joined at the edges 300.

The characteristic feature of the present invention lies in the back portion 200 in which a synthetic fiber, selected according to a desired glove texture as well as sports application, is blended with spandex to form a composite elastic material having a high degree of elasticity together with breathability and durability. A wide assortment of materials are available for use as the synthetic fiber, e.g., nylon, and other common polyester fabrics. The synthetic fiber constitutes 85~95% by weight of the back portion 200 and spandex constitutes the remaining 5~15%. More preferably, the synthetic fiber constitutes 91~92% by weight of the back portion 200 and spandex constitutes the remaining 8~9%. One side of the material of the back portion 200 is preferably nap-processed to achieve a brushed, suede-like appearance and soft feel. It is also preferable to include fourchettes 400 for each finger of the back portion 200, which are made of the same composite elastic material.

When the user (wearer) dons the anti-slip athletic glove according to the present invention and grips a golf club shaft handle (grip) or similar device, the palm portion 100 becomes gathered in the palm during the gripping action. In doing so, the back portion 200 stretches as necessary, so that a snug fit, one which supports and bolsters the grip, is maintained.

Figure 3:
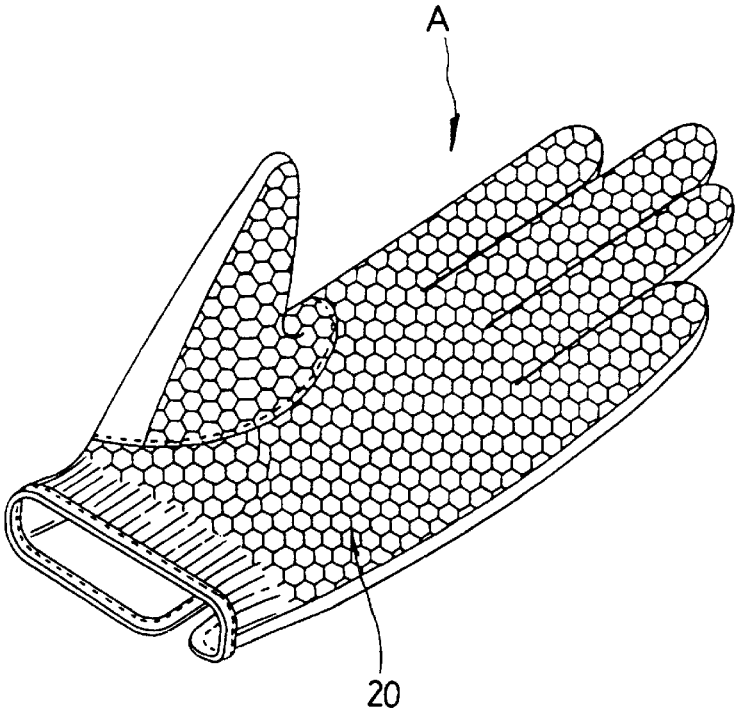
FIG. 3 is a perspective view of an athletic glove, according to a preferred embodiment of the present invention, particularly illustrating a palm portion thereof.
Figure 4:
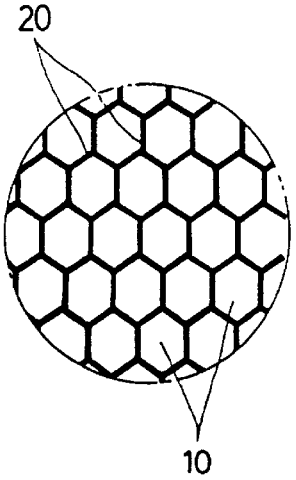
FIG. 4 is an enlarged plan view of a hexagon-patterned silicone sealant, which has penetrated into the fibers of the palm portion shown in FIG. 3.
Figure 5:
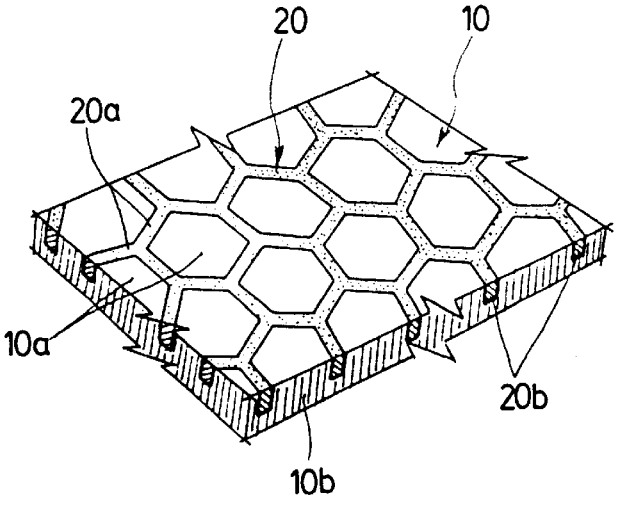
FIG. 5 is an enlarged perspective view of a section of the palm portion shown in FIG. 3.

A particularly suitable material for the palm portion 100 is a thin, soft and supple polyurethane-impregnated artificial leather, but other synthetic and made-made materials, whether woven or non-woven, including natural leathers and leather-like man-made fabrics, may be used. FIGS. 3–5 illustrate the palm portion of an anti-slip athletic glove having improved fit, according to a preferred embodiment of the present invention.

As shown in FIG. 3, the palm portion (100) is comprised of a palm piece and a thumb piece, which include opposing contact areas of a glove A on which a hexagon pattern 20 of silicone sealant is printed by a silk-printing method using, preferably, a two-part silicone sealant. As the two-part silicone sealant, KE-1300T silicone with CAT-1300 hardening agent (each manufactured by Shin-Etsu Chemical of Japan) may be used, in which 10–30% by volume of the hardening agent is added to the silicone and thoroughly mixed before application.

The above-described palm portion is preferably obtained by a process comprising the steps of: silk-printing a predetermined amount of a two-part silicone sealant in a repeated pattern on an exterior surface of the artificial leather material; holding the printed leather material at a temperature of 10–30° C., to allow for a predetermined amount of penetration of the silicone sealant; and curing the silicone-sealant-penetrated leather material for up to two minutes at a temperature of 130–170° C.

Referring to FIGS. 4 and 5, the gripping ability of the glove A is derived partly from a contact surface 20*a* of the silicone sealant together with an anchored channel 20*b* thereof, which is penetrated into polyurethane fiber 10*b* to a depth of approximately half its thickness, and partly from a bare surface area 10*a* of artificial leather 10. These two surfaces, 10*a* and 20*a,* generally preserve the substantially level surface of the original artificial leather, i.e., before printing, but the contact surface may protrude slightly as long as a capillary action between the contact surface and the artificial leather is allowed. The hexagon pattern 20 of silicone sealant covers a minority surface area portion of preferably 20–40% of an exterior contact area portion of the palm portion, with the silicone sealant being properly penetrated into and bonded with the polyurethane fiber 10*b* after printing. Though a hexagon pattern is shown, any repeated pattern may be used, including repeated patterns of fine lines, small dots, geometric shapes, alphanumeric characters, or a combination thereof.

There are several unexpected benefits of the anti-slip athletic glove having improved fit according to the present invention.

First, the elasticity of the back portion 200, being in contrast to the anti-slip function of the palm portion 100, provide improved fit characteristics and promote good gripping ability with a high degree of sensitivity.

Second, the synthetic fiber and spandex of the composite elastic material of the back portion 200 provide for a good fit over long periods of repeated usage, with high flexibility and breathability characteristics.

Third, since the composite elastic material can be provided with a nap side, enhanced suede-like appearance and feel can be attained.

Additional modifications and improvements of the invention may also be apparent to those skilled in the art. Thus, the particular combination of parts described and illustrated herein is intended to represent only one embodiment of the invention, and is not intended to serve as limitations of alternative devices within the spirit and scope of the invention, in which the palm portion of an athletic glove is made of an anti-slip material while the back portion thereof is wholly made of a composite elastic material for flexibility and improved fit during gripping. Further, those skilled in the art will recognize that the sports glove defined and claimed herein is additionally applicable for other non-sports, special use endeavors requiring improved gripping ability and improved fit simultaneously, such as aviation flight gloves and the like; and for the purposes of this application the term sports gloves shall be defined to encompass such broader meaning.

What is claimed is:

1. An athletic glove comprising a back portion and a palm portion combined with the back portion, to fit the human hand snugly by being joined along edges of each portion in a substantially continuous manner, said palm portion providing an anti-slip function, wherein said back portion consists essentially of a composite elastic material, said composite elastic material being comprised of a blend of synthetic fiber and spandex, the entire palm portion including a single layer of leather having an exterior contact area for gripping wherein the synthetic fiber comprises 91% to 95% by weight of said composite elastic material.

2. The athletic glove as claimed in claim 1, wherein the synthetic fiber comprises 91% to 92% by weight of said composite elastic material.

3. The athletic glove as claimed in claim 1, wherein the spandex comprises 5% to 9% by weight of said composite elastic material.

4. The athletic glove as claimed in claim 1, wherein the spandex comprises 8% to 9% by weight of said composite elastic material.

5. The athletic glove as claimed in claim 1, wherein said composite elastic material undergoes nap-processing.

6. The athletic glove as claimed in claim 1, wherein said back portion comprises a separate portion for the thumb.

7. The athletic glove as claimed in claim 1, further comprising finger fourchettes.

8. The athletic glove as claimed in claim 7, wherein said composite elastic material extends to the finger fourchettes.

9. The athletic glove as claimed in claim 1, wherein the single layer of layer of leather of the palm portion is an artificial leather having an exterior contact area portion for gripping; and a pattern made of silicone sealant printed on said artificial leather to form a contact surface covering a minority of the exterior contact area portion for gripping, by penetrating said printed pattern of silicone sealant into said artificial leather to form a plurality of anchored channels, the contact surface occupying substantially the same plane as the exterior contact area portion for gripping, to allow for a capillary action between the contact surface and said artificial leather.

10. The athletic glove as claimed in claim 9, wherein the contact surface protrudes above the surface of the external contact area portion for gripping.

* * * * *